United States Patent [19]

Snavely

[11] 3,992,608

[45] Nov. 16, 1976

[54] COMBINATION ATTACHMENT FOR WATER HEATER ELECTRIC HEATING ELEMENT AND THERMOSTAT

[75] Inventor: Robert L. Snavely, Kankakee, Ill.

[73] Assignee: A. O. Smith Corporation, Milwaukee, Wis.

[22] Filed: Oct. 1, 1975

[21] Appl. No.: 618,562

[52] U.S. Cl. ..... 219/336; 219/536; 211/26

[51] Int. Cl.[2] ..... F24H 1/00

[58] Field of Search ..... 219/336, 318, 335, 523, 219/536; 211/13, 26

[56] References Cited

UNITED STATES PATENTS

| | | | |
|---|---|---|---|
| 2,561,474 | 7/1951 | Ingels | 219/336 |
| 3,056,879 | 10/1962 | Fischer | 219/318 |
| 3,193,662 | 7/1965 | Brandt | 219/318 X |
| 3,217,138 | 11/1965 | Drugmand | 219/336 |

*Primary Examiner*—C. L. Albritton

*Attorney, Agent, or Firm*—Andrus, Sceales, Starke & Sawall

[57] ABSTRACT

Attachment for securing an electric heating element and a thermostat to a water heater. An external fitting is welded around an opening in a water heater tank through which the heating element extends and is secured to oppositely disposed flanges on the outer portion of the fitting by a selectively rotatable latching cap which has ears on the inside which engage the inner portion of the respective flanges of the fitting. A bracket engages the thermostat at the upper end and has a pair of spaced arms at the lower end extending along each side of the fitting with an upstanding abutment on each arm which engages the underside of the flanges of the fitting to hold the bracket and the thermostat against the tank wall. A second upstanding abutment of greater height than the first abutments is located between the first mentioned abutments and engages the fitting flanges to prevent rotation of the bracket.

5 Claims, 7 Drawing Figures

Fig. 4
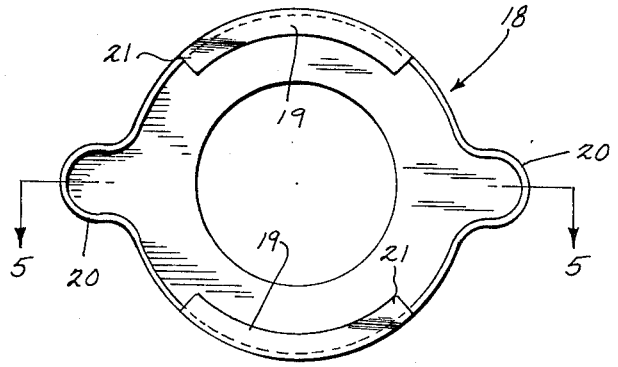
Fig. 7
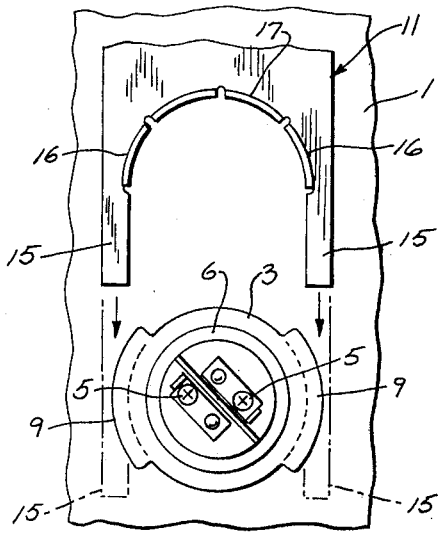
Fig. 5
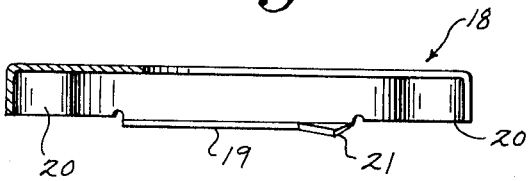
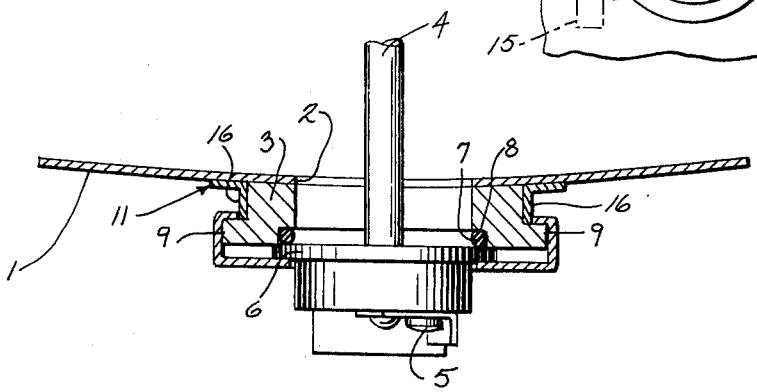
Fig. 6

COMBINATION ATTACHMENT FOR WATER HEATER ELECTRIC HEATING ELEMENT AND THERMOSTAT

BACKGROUND OF THE INVENTION

The invention eliminates a separate connection of an electric heating element to a water heater tank and a separate securing of a thermostat to the wall of the tank by the employment of a single fitting secured to the tank wall which is constructed as an attachment for holding the electric heating element in place and receives the arms of a bracket for securing a thermostat in engagement with the wall of the heater tank.

SUMMARY OF THE INVENTION

The invention in general is directed to an annular external fitting or spud which is welded or otherwise secured to the tank of a water heater around an opening through which an electric heating element can be inserted. A flange on the outer end of the heating element overlies the outer end of the fitting and is secured to oppositely disposed flanges on the outer end of the fitting by a selectively rotatable locking cap.

The thermostat is held against the outer surfaces of the wall of the water heater tank by a bracket which at the upper end engages the thermostat housing and has a pair of spaced arms which extend from a semicircular opening in the bracket on opposite sides of the fitting. Abutments on each of the arms engage the underside of the respective flanges of the fitting to hold the bracket securely in place against the wall of the tank and a slightly higher abutment extending along the edge of the bracket at the semicircular opening in the bracket engages the inner sides of the flanges on the fitting to prevent rotation of the bracket and thermostat. Clearance between the latter abutment and the ears of the locking cap permits rotation of the cap into locking engagement with the flanges on the fitting.

DESCRIPTION OF THE DRAWINGS

FIG. 4 is a bottom elevational view of the locking cap employed with the invention;

FIG. 5 is a sectional view taken on line 5—5 of FIG. 4;

FIG. 6 is a sectional view taken on line 6—6 of FIG. 3; and

FIG. 7 is a top plan view of a portion of the bracket as it appears located adjacent the fitting.

DESCRIPTION OF THE INVENTION

Figure 1:
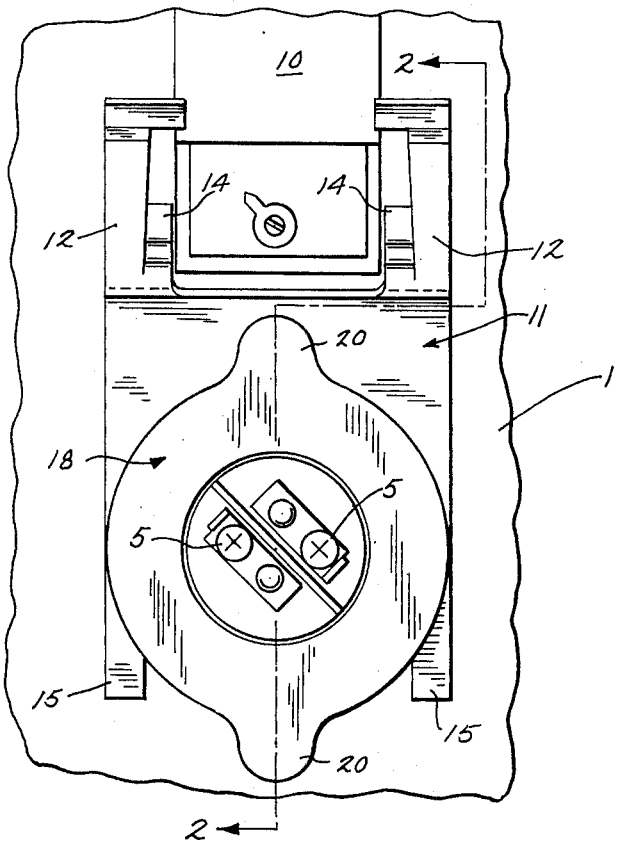
FIG. 1 is a front elevational view of the attachment of the invention.

Referring to the drawings, there is shown tank wall 1 of a water heater having an annular opening 2 surrounded by annular fitting 3 through which extends the electric heating element 4 having the electrical connections 5 on the face thereof for connection to a source of electric power.

The annular fitting 3 is welded to wall 1. Element 4 has a flange 6 which overlies fitting 3 and fitting 3 has an internal annular groove 7 beneath flange 6 which receives the O-ring 8 to provide a water tight seal between flange 6 of element 4 and fitting 3 when heating element 4 is finally assembled with the water heater.

Figure 2:
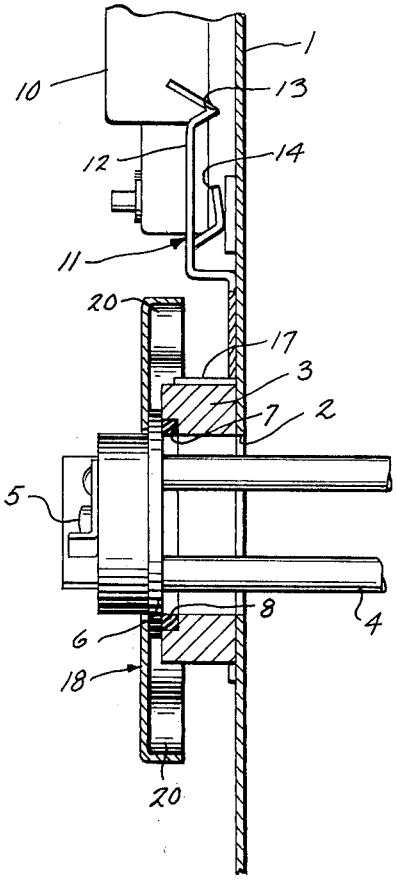
FIG. 2 is a sectional view taken on line 2—2 of FIG. 1 with parts in elevation.
Figure 3:
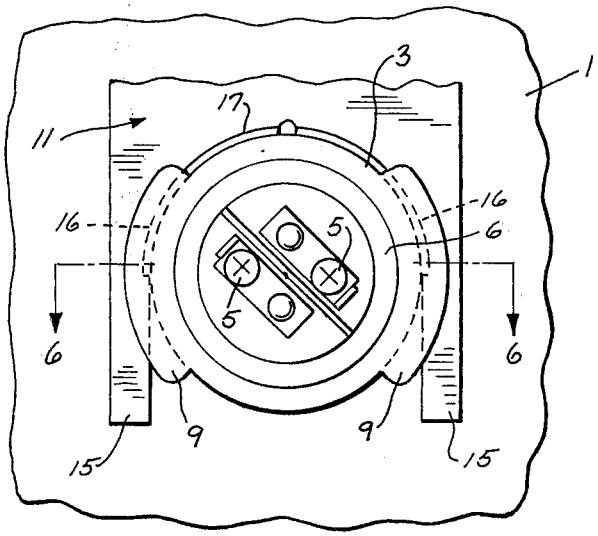
FIG. 3 is a front elevational view of the fitting and thermostat bracket with the cap off and heating element in place.

As illustrated in FIG. 2, the outer portion of fitting 3 has oppositely disposed flanges 9 which lie in a plane substantially parallel with respect to wall 1 of the water heater.

The thermostat 10 is located above the annular fitting 3 and is held securely against wall 1 of the water heater by the bracket 11.

Bracket 11 has a pair of upwardly extending spaced arms 12 which extend along each side of thermostat 10. The upper ends of the arms 12 are grooved to fit within complementary grooves 13 in thermostat 10. The fingers 14 are formed inwardly of arms 12 and engage the opposite side walls of thermostat 10 beneath arms 12 to prevent rotation of thermostat 10 in service.

Bracket 11 has a semicircular opening for partially encircling fitting 3 and a downwardly extending pair of arms 15 which project over the tank wall along the sides of fitting 3 and beneath the flanges 9 of fitting 3. Each arm 15 has an upstanding abutment 16 of the order of one-quarter of an inch in height which projects upwardly and in secure engagement with the underside of each respective fitting flange 9 to securely hold the thermostat bracket 11 against the wall of tank 1.

In order to prevent rotation of bracket 11, a second upstanding abutment 17 of slightly greater height than abutments 16 such as of the order of five-sixteenths of an inch extends approximately 180° along the semicircular opening in bracket 11 in engagement with the inner peripheral surface of the respective flanges 9 of fitting 3.

In the final assembly of the attachment a locking cap 18 is provided which has oppositely located internal ears 19 and upon rotation of cap 18 ears 19 are lodged beneath flanges 9 of fitting 3 to secure the heating element 4 to the fitting. Projections 20 are provided on locking cap 18 for ready rotation of cap 19.

As illustrated in FIG. 5, the internal retaining ears 19 each have high starting lips 21 on the leading edge which permits easy starting engagement with flanges 9 but provides an increasingly tighter connection with flanges 9 as the locking cap 18 is rotated into engagement with fitting flanges 9.

Under one way of assembling the thermostat 10 and heating element 4 with wall 1 of the water heater, the annular fitting 3 with the flanges 9 thereon is first welded to the outside of wall 1 around opening 2 which has been provided therein.

Next the O-ring 8 is lodged in annular groove 7 in fitting 3 and electric heating element 4 is inserted through opening 2 until the flange 6 on element 4 engages O-ring 8 and the outer face of fitting 3. Thereafter locking cap 18 is located over fitting 3 and is rotated to place retaining ears 19 in engagement with flanges 9 in locking position.

The bracket 11 is then assembled with fitting 3 so that the upper portion of the bracket engages thermostat 10 and the lower portion is in semicircular engagement with fitting 3 and the arms 15 having the upstanding abutments 16 project on each side of fitting 3 to place the abutments 16 in engagement with the under surface of the respective flanges 9 of fitting 3. By this engagement bracket 11 is held securely against the wall of the tank to in turn secure the thermostat 10 in tight engagement with tank wall 1. At the edge of the semicircular engagement of bracket 11 with fitting 5 the upstanding abutment 17 on bracket 11 engages fitting flanges 9 and prevents rotation of bracket 11 and thermostat 10.

Once the fitting 3 is secured to wall 1 of the water heater other methods than that described of assembly of the thermostat and electric heating element with fitting 5 may be employed.

Various modes of carrying out the invention are contemplated as being within the scope of the following claims particularly pointing out and distinctly claiming the subject matter which is regarded as the invention.

I claim:

1. A combination electric heating element and thermostat attachment to a water heater tank, which comprises an external fitting secured around an opening in a wall of the water heater tank, a pair of oppositely disposed flange members located on the fitting adjacent the outer end, a bracket disposed to hold the thermostat against the wall of the tank and having a pair of arm members extending respectively over the wall of the tank on opposite sides of the fitting, abutment means secured to one pair of said flange and arm members and disposed to securely hold said bracket and the thermostat securely against the wall of the tank, means preventing rotation of the bracket when the arm members are in engagement with the flange members of the fitting, and locking means overlying the flange members of the fitting and having means thereon selectively disposed in engagement with the fitting flange members and electric heating element to secure the electric heating element securely to the fitting.

2. The combination of claim 1, and the abutment means being upstanding abutments provided on the arm members.

3. The combination of claim 2, and the bracket being formed in a semicircular extent between said arm members in the general configuration of the fitting, and the means preventing rotation of the bracket being an upstanding abutment provided along the semicircular extent of the bracket and of a height to engage the peripheral surface of the flange members of the fitting.

4. The combination of claim 3, and the locking means overlying the flange members being a cap having oppositely disposed internal ears for engagement with the flange members.

5. The combination of claim 4, and high starting lips provided on the leading side of the ears of the locking cap to permit easy starting engagement with the flange members and increasingly tighter connection with the flange members on the fitting as the locking cap is rotated.

* * * * *